US007207776B2

(12) United States Patent
Townes et al.

(10) Patent No.: US 7,207,776 B2
(45) Date of Patent: Apr. 24, 2007

(54) COOLING ARRANGEMENT

(75) Inventors: Roderick M Townes, Derby (GB); Changmin Son, Derby (GB); Colin Young, Derby (GB)

(73) Assignee: Rolls-Royce plc, London (GB)

( * ) Notice: Subject to any disclaimer, the term of this patent is extended or adjusted under 35 U.S.C. 154(b) by 83 days.

(21) Appl. No.: 11/016,994

(22) Filed: Dec. 21, 2004

(65) Prior Publication Data

US 2005/0232751 A1 Oct. 20, 2005

(30) Foreign Application Priority Data

Dec. 18, 2003 (GB) ..... 0329386.7

(51) Int. Cl.
*F01D 5/30* (2006.01)

(52) U.S. Cl. ..... 416/95; 416/193 A; 416/220 R; 416/248

(58) Field of Classification Search ..... 416/193 A, 416/244 A, 248, 95, 219 R, 220 R
See application file for complete search history.

(56) References Cited

U.S. PATENT DOCUMENTS 2,656,147 A 10/1953 Brownhill
5,222,865 A 6/1993 Corsmeier
5,281,097 A 1/1994 Wilson
5,388,962 A 2/1995 Wygle
5,836,742 A 11/1998 Dierksmeier
6,416,282 B1 * 7/2002 Beeck et al. ..... 416/95

FOREIGN PATENT DOCUMENTS

EP 1 464 792 A 10/2004

* cited by examiner

*Primary Examiner*—Richard A. Edgar
(74) *Attorney, Agent, or Firm*—W. Warren Taltavull; Manelli Denison & Selter PLLC

(57) ABSTRACT

A cooling arrangement comprises a support (20) for a plurality of blades (22). The support (20) comprises a plurality of blade mounting members (28) provided between adjacent blades (22). The blades (22) are mounted upon the blade mounting members (28). The cooling arrangement defines a pathway (36) for a cooling fluid. The cooling arrangement further includes a fluid directing formation (40, 44, 44A) to direct the cooling fluid across the blade mounting member (28).

23 Claims, 11 Drawing Sheets

COOLING ARRANGEMENT

FIELD OF THE INVENTION

This invention relates to cooling arrangements. More particularly, but not exclusively, the invention relates to cooling arrangements for cooling discs of turbines, for example turbines in gas turbine engines.

BACKGROUND OF THE INVENTION

The turbines of a gas turbine engine operate at a high temperature, which can lead to a short lifetime of the components. Cooling air is used to reduce the temperature of these components during operation of the turbine. The cooling air is provided indirectly by air used for sealing purposes and/or low pressure feed purposes. The effectiveness of this cooling is not very high and, in engines where the cycle and operating conditions lead to particularly high temperatures, the turbine disc ring can overheat.

SUMMARY OF THE INVENTION

According to one aspect of this invention, there is provided a cooling arrangement comprising a support for a plurality of blades, the support comprising a plurality of blade mounting members provided between adjacent blades, upon which the plurality of blades can be mounted, wherein the cooling arrangement defines a pathway for a cooling fluid, and the cooling arrangement further includes a fluid directing member to direct the cooling fluid across the blade mounting member.

Preferably, the fluid directing member comprises an aerodynamically configured element. The fluid directing member may comprise an aerofoil element.

The blade mounting member may comprise a main portion, and the fluid directing formation may be provided on the main portion. The fluid directing formation may extend outwardly from the blade mounting member. In one embodiment, the fluid directing formation may extend in a downstream or upstream direction from the main portion.

The support may include a securing member for securing at least one blade onto the support. In some embodiments, the fluid directing formation may be provided on the securing member, and may extend from the securing member toward the blade engaging member. The securing member may comprise a seal plate. At least some of the fluid pathway may be defined between the securing member and the blade mounting member. The fluid directing formation may extend in a downstream or upstream direction from the securing member.

The blade mounting member may comprise an outer surface extending between adjacent blades. The fluid directing formation may be arranged to direct cooling fluid across the outer surface, conveniently externally thereof. Preferably, the fluid directed across the outer surface is in the form of a film of said fluid thereacross.

The fluid pathway may comprise at least one, and preferably a plurality, of channels extending across the outer surface. In one embodiment, the or each channel comprises an internal elongate conduit extending through the blade mounting member, conveniently adjacent the outer surface thereof. In another embodiment, the or each channel comprises an elongate recess. The elongate recess may have an elongate opening in the outer surface of the blade mounting member, or may have an opening in the side of the blade mounting member. Where the elongate recess opens into the side of the blade mounting member, an internal conduit may be defined with the blade that engages the aforesaid side of the blade mounting member.

Where the fluid directing formation is provided on the securing member, the fluid directing formation may extend at least partially across the outer surface of the blade mounting member. Preferably, the cooling arrangement is for cooling the rim of a turbine disc. The support may comprise the aforesaid disc. Preferably, the blades are arranged circumferentially around the disc, extending radially outwardly therefrom.

BRIEF DESCRIPTION OF THE DRAWINGS

Embodiments of the invention will now be described by way of example only, with reference to the accompanying drawings, in which:—

DETAILED DESCRIPTION OF THE DRAWINGS

Figure 1:
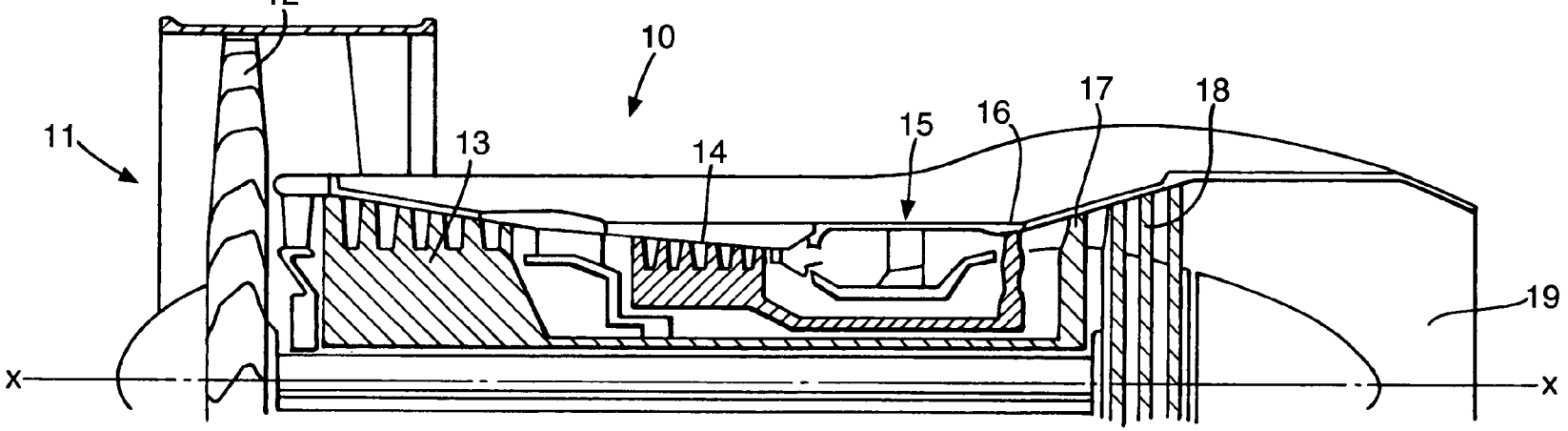
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
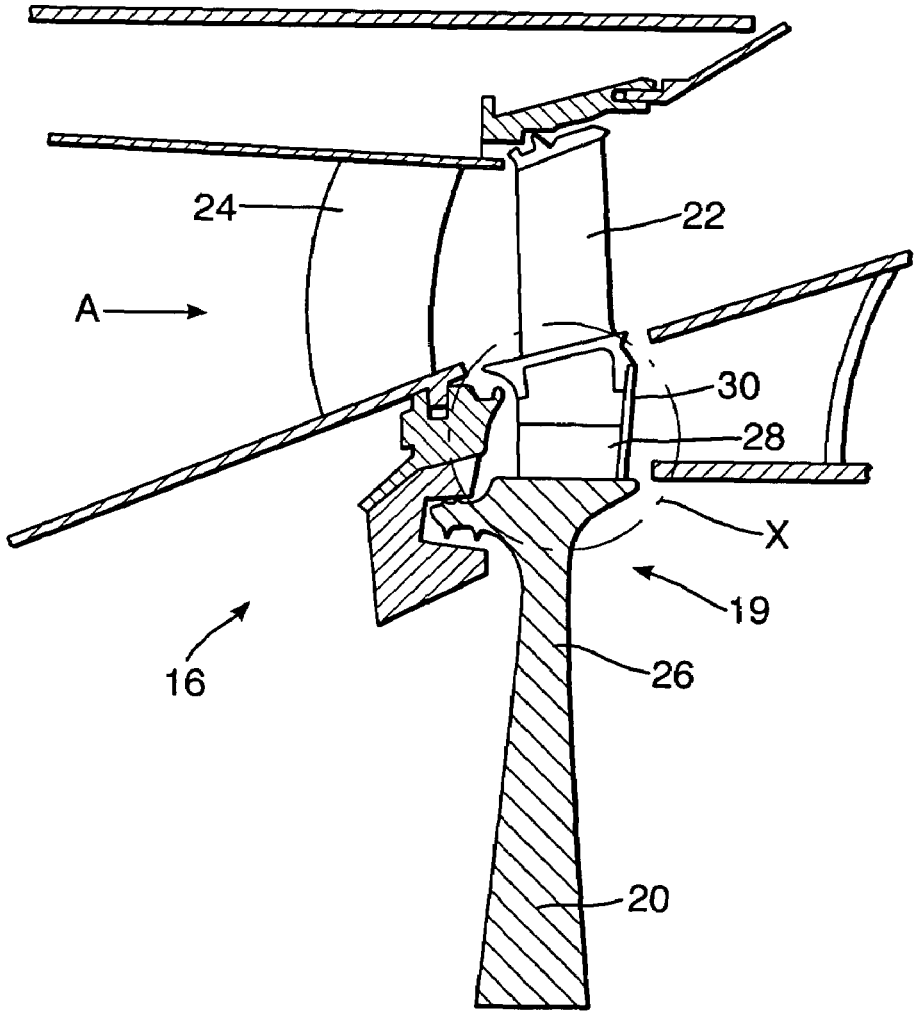
FIG. 2 is a sectional side view of a high pressure turbine.

Referring to FIG. 2, there is shown in more detail, an upper region of the high pressure turbine 16 of the engine 10 shown in FIG. 1. The high pressure turbine 16 comprises a rotary part 19, which comprises a disc 20 upon which a plurality of turbine blades 22 are mounted. The blades 22 are mounted one after the other circumferentially around the disc 20, and each blade 22 extends radially outwardly from the disc 20. Air passes in the direction shown by the arrow A from the combustion equipment 15 onto nozzle guide vanes 24, from which the air is directed onto the turbine blades 22 causing the rotary part 19 of the turbine to rotate.

Since the air delivered to the blades 22 of the high pressure turbine 16 has been heated by the combustion equipment 15, cooling is required to ensure a suitable length of life of the components of the high pressure turbine 16. In this connection, the disc 20 supporting the blades 22 comprises a main body 26 and a plurality of blade mounting members 28 extending radially outwardly from the main body 26. The blades 22 are secured to the disc 20 by suitable securing means in the form of a circumferentially extending seal plate 30 secured to the downstream face of the disc 20. In FIG. 2, a circle marked X shows a region of the rim of the disc 20, at which the blades 22 are secured to the disc 20, and a detailed version of part of this region of the rim is shown in FIG. 3.

Figure 3:
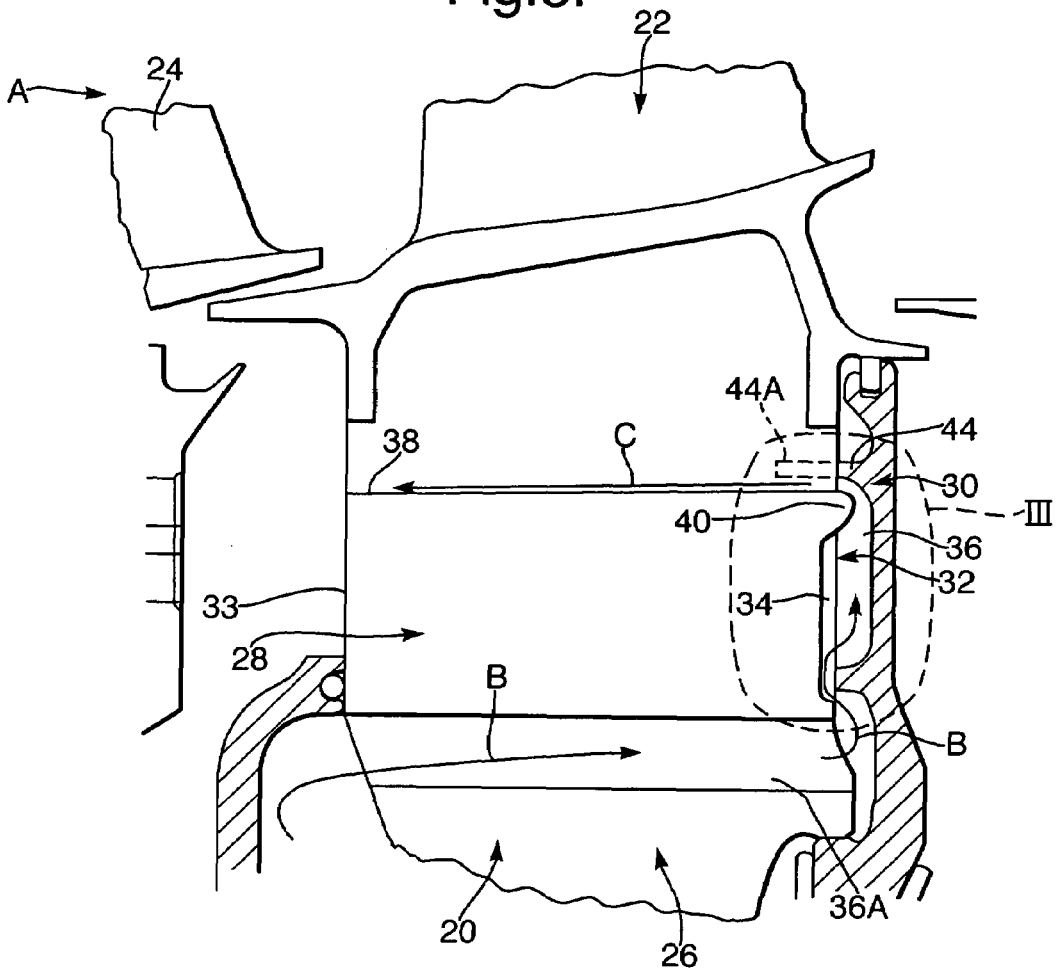
FIG. 3 is a sectional side view of the region marked X in FIG. 2, showing an embodiment.
Figure 4:
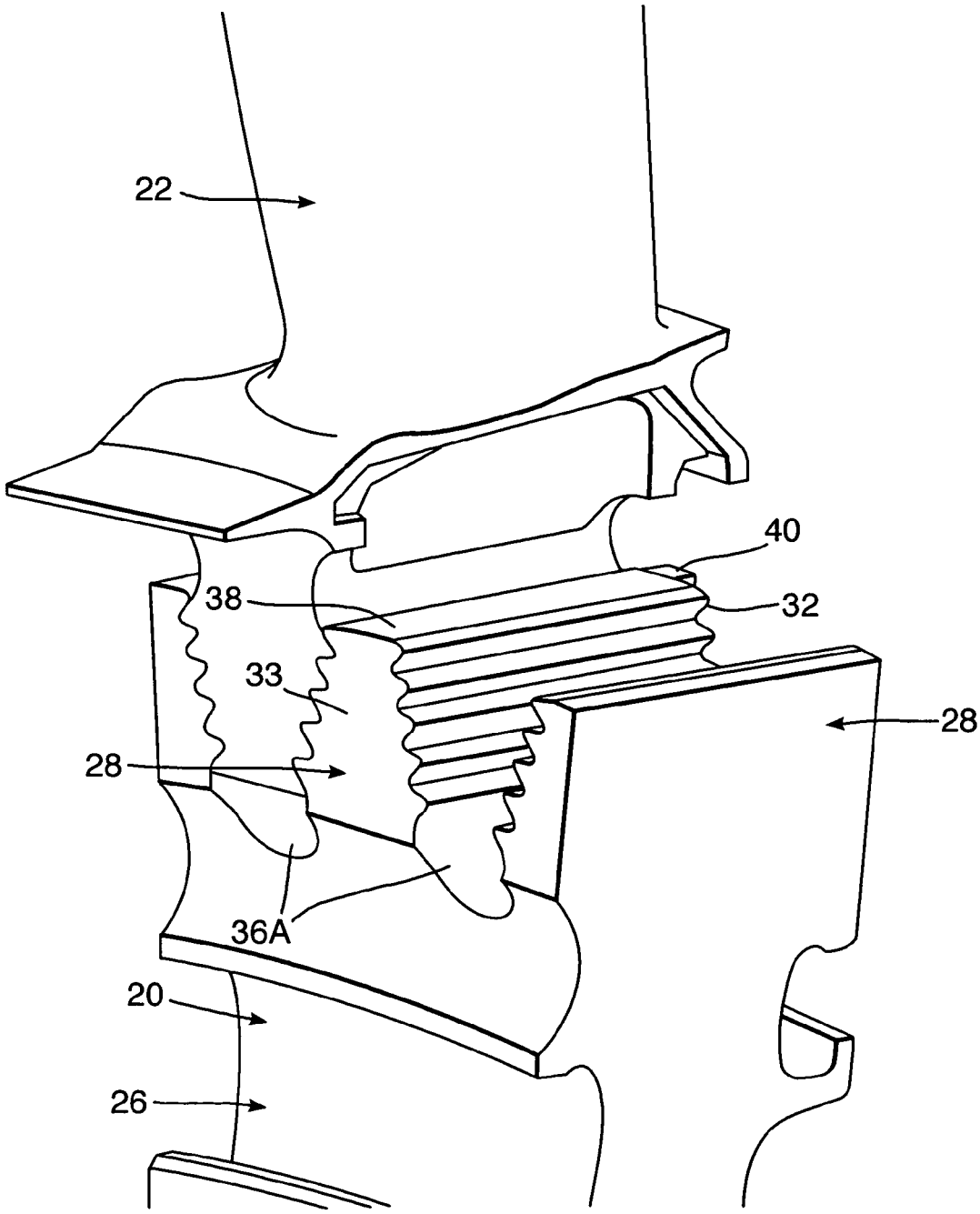
FIG. 4 is a perspective view, from the front, of the region of the high pressure turbine shown in FIG. 3.

Referring to FIGS. 2, 3 and 4, air passing through the high pressure turbine 16 flows in the direction indicated by the arrow A from an upstream direction to a downstream direction.

Each blade mounting member 28 has a downstream or rear face 32, and an upstream or first face 33. In the embodiment shown, the rear face 32 defines a recessed region 34. The seal plate 30 (not shown in FIG. 4) is mounted over the rear face 32 to define with the recessed region 34 a fluid pathway 36 for a cooling fluid. The fluid pathway 36 extends as a conduit 36A through the disc 20 radially inwardly of the blade engaging member 28. Cooling fluid from the high pressure compressor 14 flows through the fluid pathway 36, via the conduit 36A, as shown by the arrows B in FIG. 3. The blade mounting member 28 has a radially outer face 38, and the fluid pathway 36 extends across the outer face 38, in an upstream direction, as shown by the arrow C.

In order to ensure that the cooling fluid from the high pressure compressor 14 is directed across the outer face 38 of the blade mounting member 28, a fluid directing formation in the form of an aerofoil member 40 is provided on the blade mounting member 28. The aerofoil member 40 extends in a downstream direction from the radially outer face 38 at the rear face 32 of the blade mounting member 28.

Referring to FIG. 3, the seal plate 30 also includes a second aerofoil member 44, which corresponds with the first mentioned aerofoil member 40, and extends towards the blade mounting member 28 radially outwardly of the outer surface 38 of the blade mounted member 28. The aerodynamic configuration of the first and second aerofoil members 40, 44 direct the cooling air as shown by the arrow C as a film across the radially outer surface 38 of the blade mounting member 28. If desired, the second aerofoil member 44 may extend at least partially across the radially outer surface 38 of the blade mounting member 28, as shown at 44A in FIG. 3.

This has the advantage that cooling air is directed across the radially outer surface 38 of the blade mounting members 28 thereby ensuring that they do not overheat.

Figure 5A:
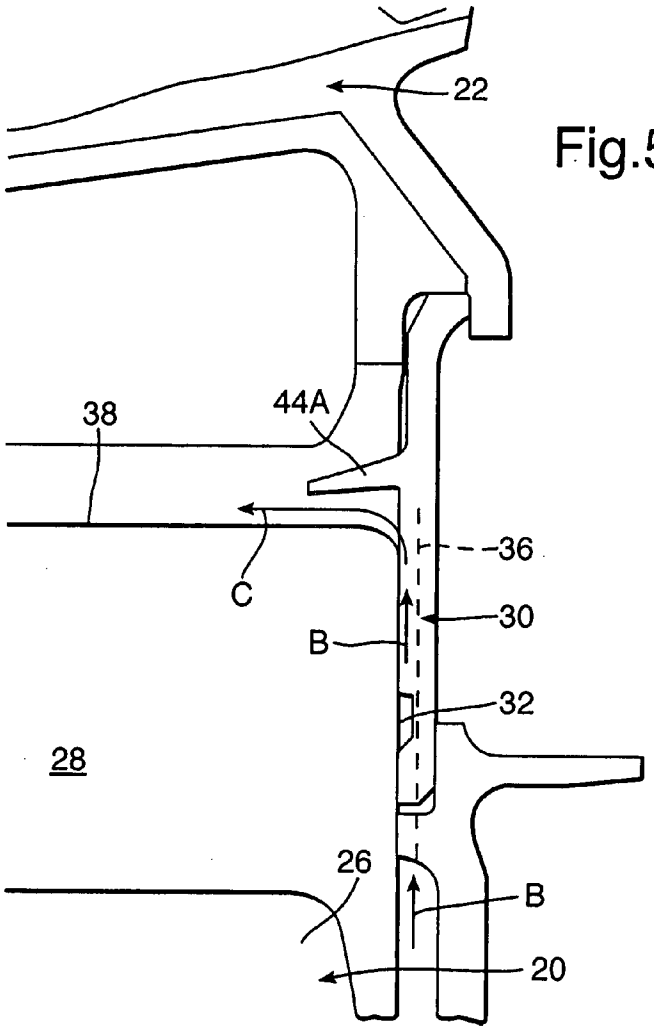
FIG. 5A is a sectional side view of the rear of the region marked X in FIG. 2, showing another embodiment.

FIG. 5A is a sectional side view of the rear of the region marked X in FIG. 2, showing another embodiment. In FIG. 5A, the aerofoil member 40 is omitted so that the cooling fluid is directed across the outer surface 38 of the blade mounting member 28 by the fluid directing formation 44A which extends partially across the outer surface 38. In this embodiment, the recessed region 34 is also omitted and the fluid pathway 36 extends between the seal plate 30 and the non-recessed rear face 32 of the blade mounting member 28.

Figure 5B:
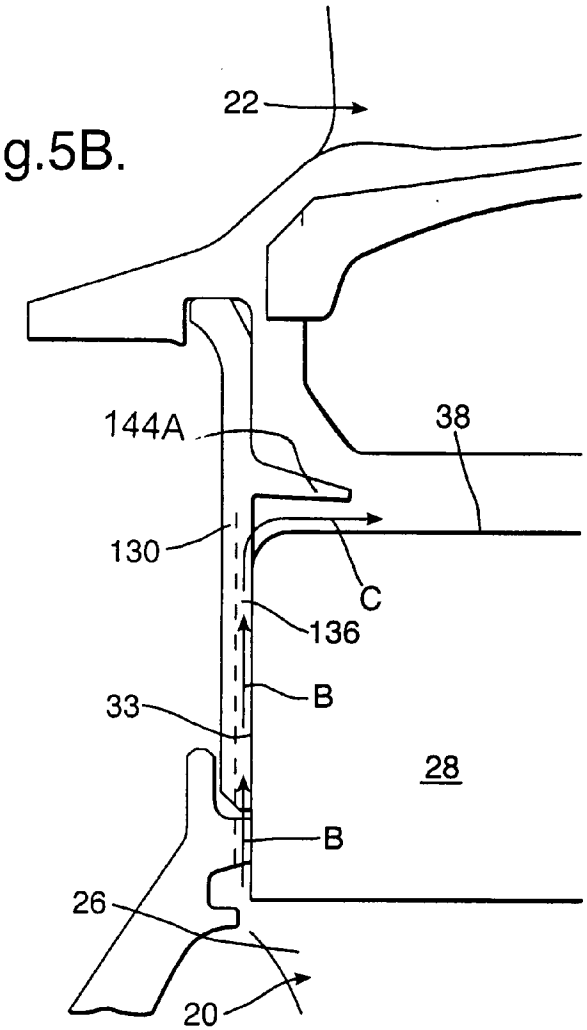
FIG. 5B is a sectional side view of the front of the region marked X in FIG. 2, showing a further embodiment.

FIG. 5B is a sectional side view of the front of the region marked X in FIG. 2, showing another embodiment. In the embodiment shown in FIG. 5B, a front seal plate 130 is provided over the front face 33 of the blade mounting member 28 and defines a fluid path 136 with the front face 33. An aerofoil member 144A directs a film of cooling fluid from the gap between the front seal plate 130 and the front face 33 over the radially outer face 38 of the blade mounting member 38, as shown by the arrow C in FIG. 5B.

Figure 6:
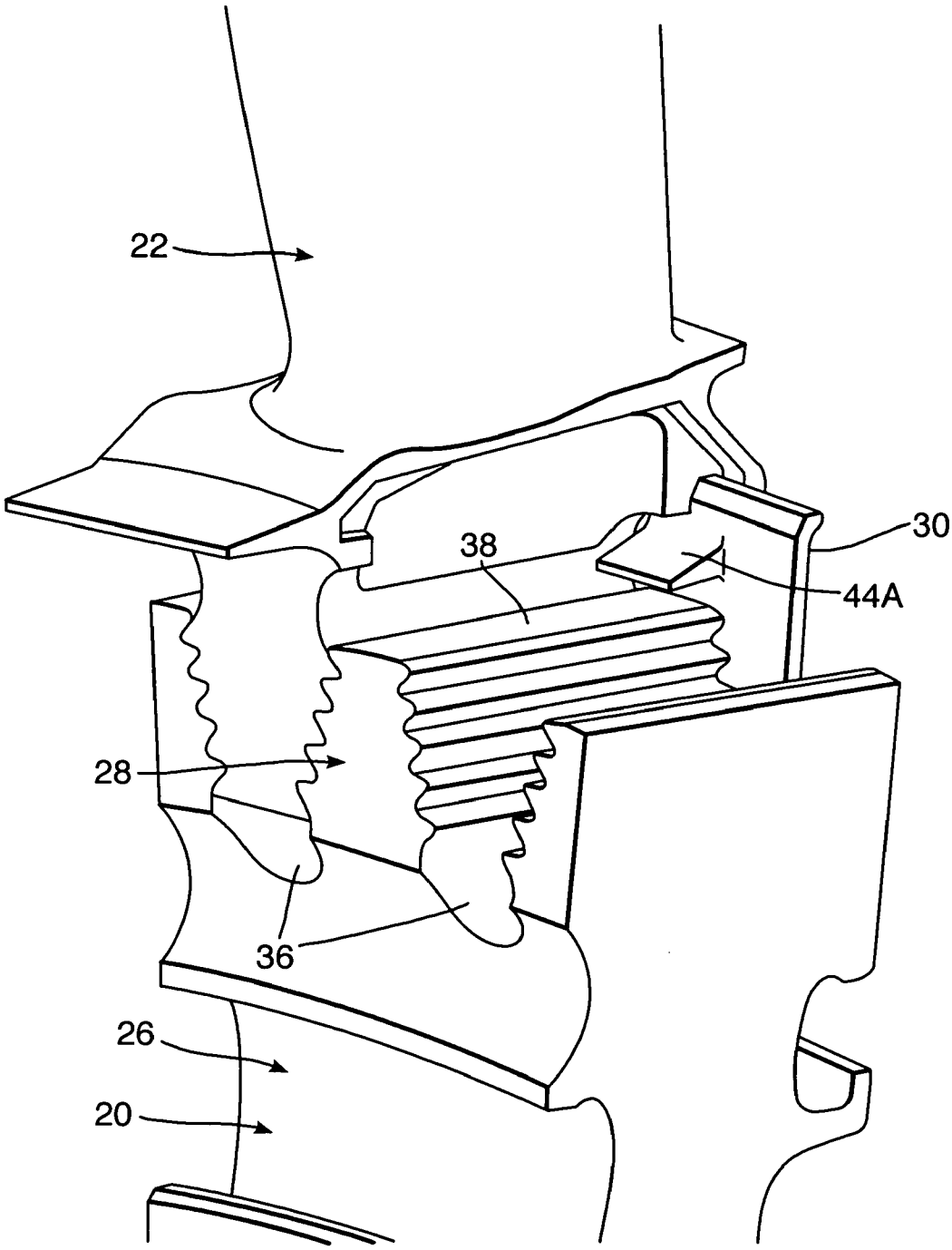
FIG. 6 is a perspective view of the embodiment shown in FIG. 5A showing the region marked X in FIG. 2.

FIG. 6 shows a perspective view of the region of the high pressure turbine 16 shown in FIG. 5A.

Figure 7:
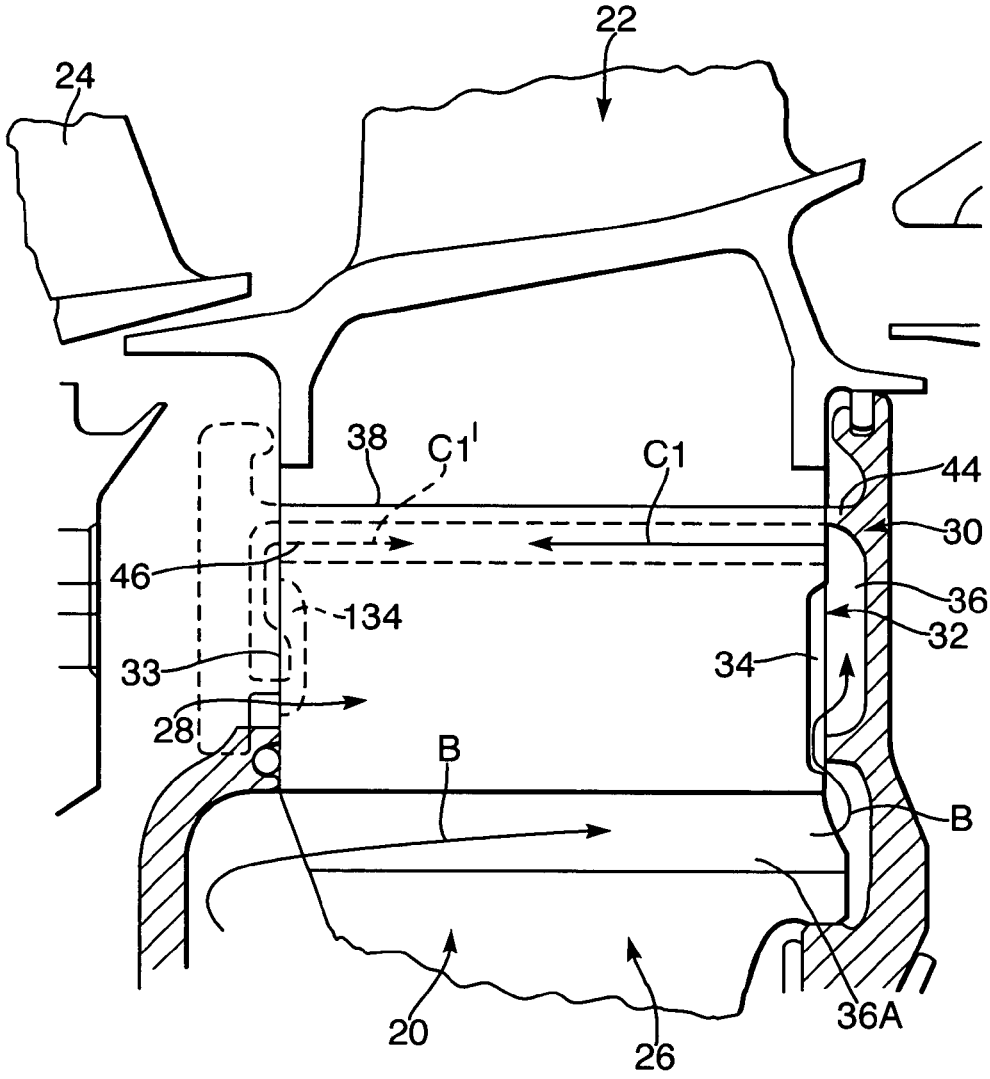
FIG. 7 is a sectional side view of the region marked X in FIG. 2; showing yet another embodiment.

Referring to FIG. 7, there is shown another version of the region marked X in FIG. 2, which comprises many of the same features as shown in FIG. 3 to 6, and these have been designated with the same reference numeral. The embodiment shown in FIG. 7 differs from that shown in FIG. 3 in that it comprises the aerofoil member 44, which is provided on the seal plate 30 and extends in an upstream direction to engage the rear face 32 of the blade mounting member 28.

Figure 10:
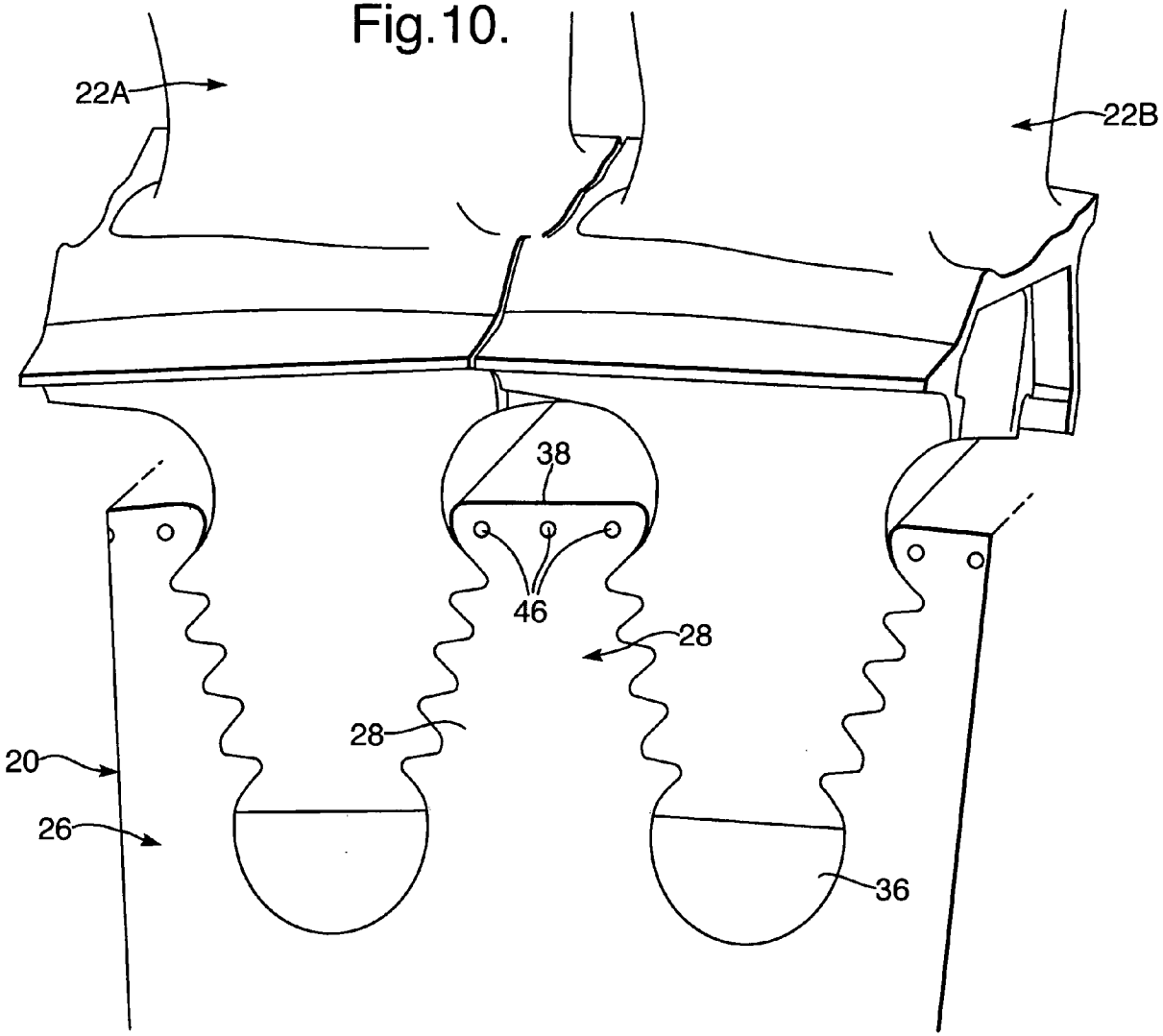
FIG. 10 is a sectional view in the downstream direction of another embodiment of the blade mounting members with blades mounted thereon, showing a part of the fluid pathway.

The blade mounting member 28 defines a plurality of axially extending internal conduits 46 defined adjacent one another at the same radial height through the blade mounting member 28 (see FIG. 10). The internal conduits extend adjacent the outer surfaces 38 of the blade mounting member 28 from the front face 33 of the blade mounting member 28 to the rear face 32 of the blade mounting member 28.

As can be seen from FIG. 7, the fluid directing formation 44 on the seal plate 30 contacts the blade mounting member 28 at a region radially outwardly of the internal conduits 46 thereby ensuring that the high pressure cooling air is directed through the internal conduits 46, as shown by the arrow C1 It will, of course, be appreciated that a seal plate 130 similar to the seal plate 30 can be provided over the front face 33 of the blade mounting member, in a similar way as shown in FIG. 5B, in addition, or as an alternative, to the seal plate 30. When a seal plate 130 is provided over the front face 33, a recess 134 is defined in the front face 35 to allow a flow of air C1' therethrough. The seal plate 130, the recess 132 and the air flow C1' are shown in broken lines.

Figure 8:
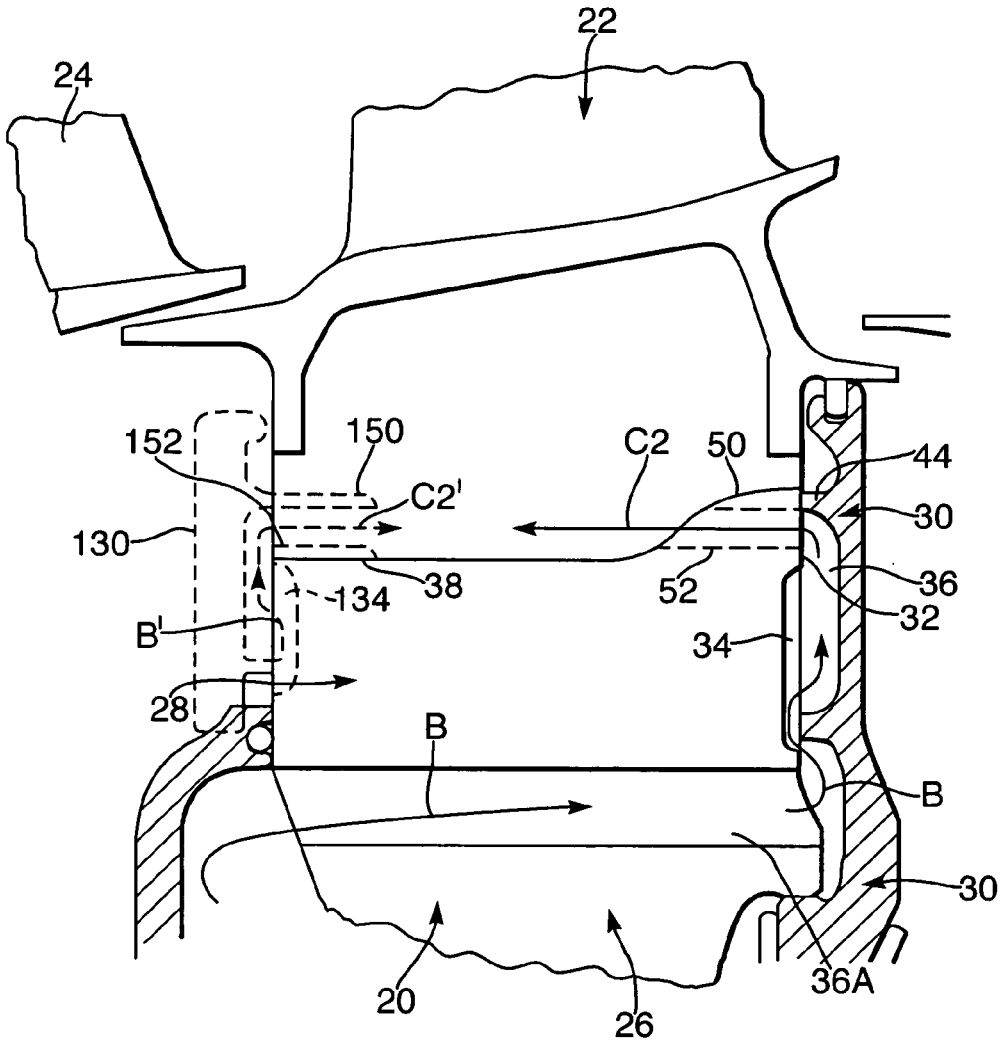
FIG. 8 is a sectional side view of the region marked X in FIG. 2, showing a still further embodiment.

Referring to FIG. 8, there is shown a further embodiment which comprises many of the same features as shown in FIGS. 3 to 7. These features are designated with the same reference numeral.

In FIG. 8, the blade mounting member 28 comprises a radially outwardly extending raised portion 50 at a downstream region of the outer surface 38 of the blade mounting member 28.

A plurality of fluid directing conduits 52 extend generally parallel to each other through the downstream raised portion 50 at the same radial height as each other. The downstream raised portion 50 terminates part way along the radially outer face 38 from the downstream face 32 of the blade mounting member 28. The fluid directing conduits 52 are provided adjacent the fluid directing formation 44 on the seal plate 30, so that air is directed by the fluid directing formation 44 into the fluid directing conduits 52. The air cooling flows through the conduits 52 in the raised portion across the outer surface of the blade engaging member.

It will be appreciated that a seal plate 130 similar to the seal plate 30, could be applied to the front face 33 of the embodiment shown in FIG. 8. Similarly a radially outwardly extending raised portion 150 could be provided with conduits 152, similar to the conduits 52. The raised portion 150 and the conduits 152 are shown in broken lines and allow a flow of air in the direction opposite to the arrows B and C, as represented by the arrows B' and C2'.

Figure 9:
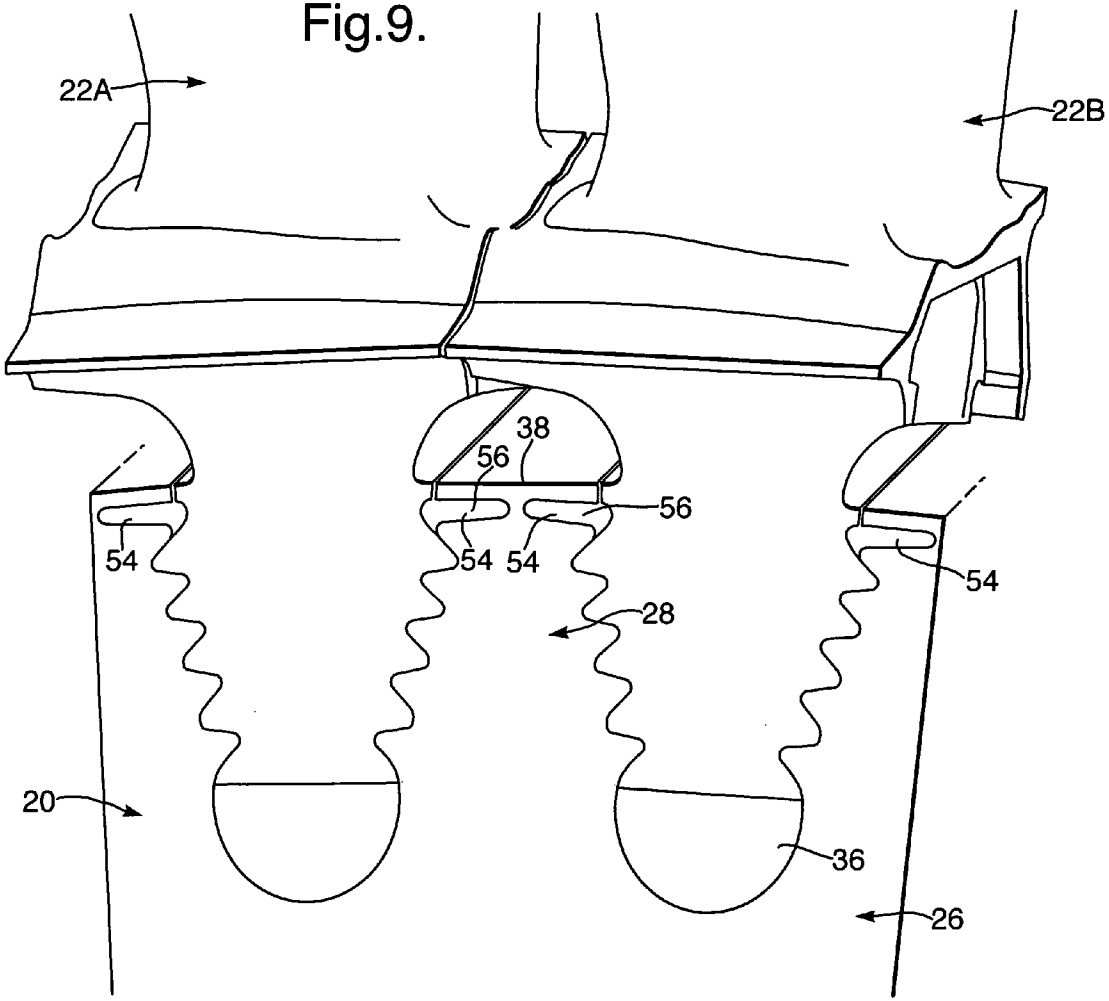
FIG. 9 is a sectional view in the downstream direction of another embodiment of the blade mounting members with blades mounted thereon showing a part of the fluid pathway.
Figure 11:
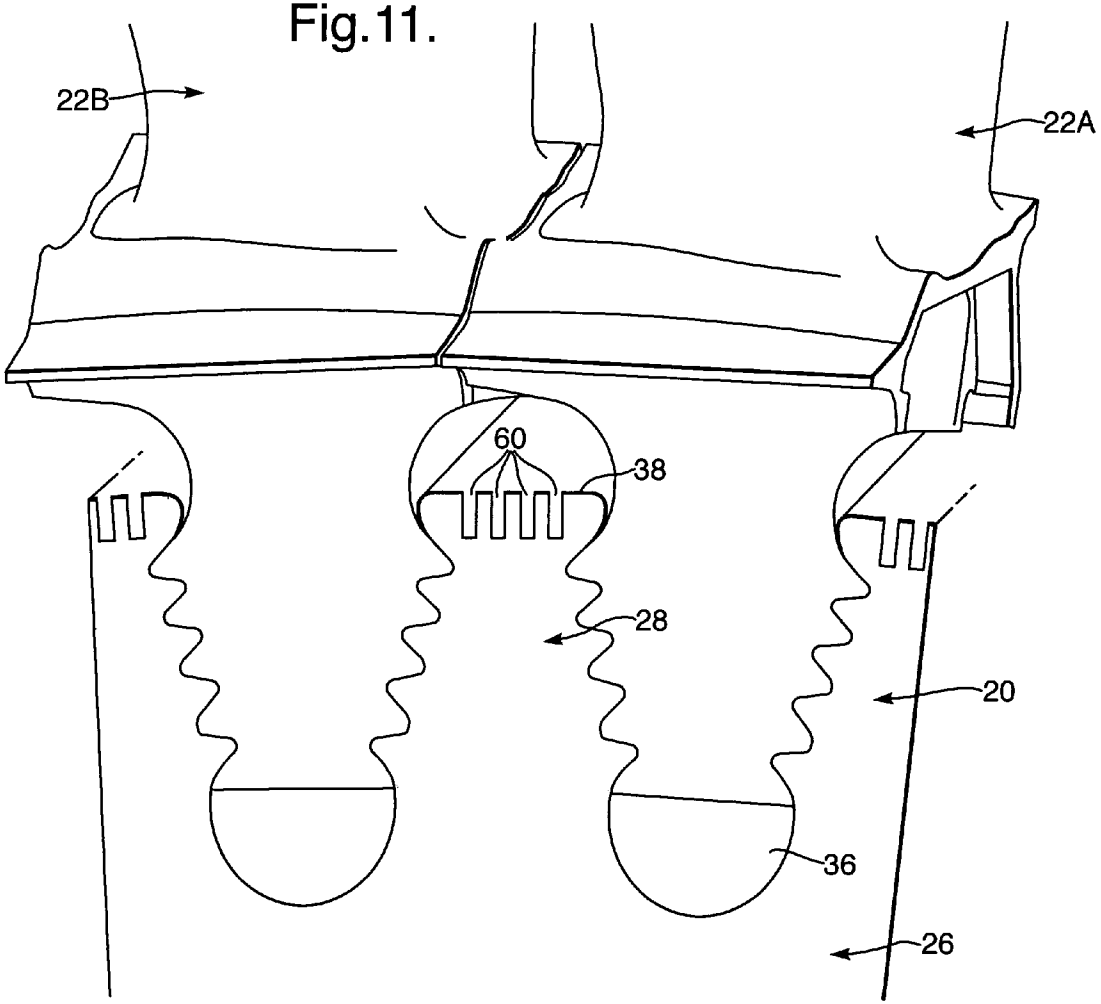
FIG. 11 is a sectional side view in the downstream direction of another embodiment of the blade mounting members with blades mounted thereon, showing a part of the fluid pathway.

FIGS. 9 to 11 show sectional views from an upstream direction of different versions of the blade mounting members 28. In FIG. 9, the blade mounting member 28 defines recesses 54 which extend lengthwise through the blade mounting member 28. The recesses also extend to the respective opposite sides of the blade mounting member 28, where two adjacent blades 22A, 22B engage the opposite sides of the blade mounting member 28. Thus the recesses 54 provide in effect internal conduits 56 which are defined by the co-operation of the blades 22A, 22B with the blade mounting member 28 so that the fluid path extends through the internal conduits 56.

FIG. 10 shows an upstream sectional side view of the embodiment shown in FIG. 7, in which a blade mounting member 28 defines a plurality of the internal apertures 46.

FIG. 11 shows a blade mounting member defining a plurality of recesses 60 opening into the radially outer surface 38 of the blade engaging member. The recesses 60 are in the form of slots.

There is thus described a cooling arrangement, the preferred embodiment of which provides cooling for the high pressure turbine of a gas turbine engine, by directing cooling fluid either across the outer surface of the blade mounting members between adjacent blades of the turbine, or through the blade mounting members in a region adjacent the outer surface thereof. This has the advantage of ensuring that the rim of the disc supporting the blades is kept at a suitable temperature to ensure a sufficient length of life.

Various modifications can be made without departing from the scope of the invention, for example where the blade engaging members are cooled by conduits or recesses, they can be of different suitable configurations. Also, the cooling fluid is described above as flowing across, or parallel to, the radially outer surface 38 in the downstream to upstream direction. It will be appreciated that the fluid flow path could be modified so that the cooling fluid flows across, or parallel, to the radially outer surface 38 in the upstream to downstream direction.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A gas turbine rotor comprising a disc having a main body, a plurality of radially extending turbine blades supported on said disc by means of said blade mounting members, one blade mounting member being provided between adjacent blades, and a securing member to secure said blades to said disc, said securing member cooperating with said blade mounting members to define therewith a plurality of cooling fluid pathways, means being provided to direct cooling fluid to said defined cooling fluid pathways and fluid directing formations being provided to direct cooling fluid from said defined cooling fluid pathways to provide cooling of the radially outer regions of said blade mounting members.

2. A gas turbine rotor according to claim 1, wherein the fluid directing formation comprises an aerofoil member.

3. A gas turbine rotor according to claim 1, wherein the blade mounting member comprises a main portion and the fluid directing formation is provided on the main portion.

4. A gas turbine rotor according to claim 1, wherein the fluid directing formation extends outwardly from the blade mounting member.

5. A gas turbine rotor according to claim 3, wherein the fluid directing formation extends in a downstream or upstream direction from the main portion.

6. A gas turbine rotor according to claim 1, wherein the support means of the blade mounting members includes a securing member and a blade engaging member for securing at least one blade onto the support.

7. A gas turbine rotor according to claim 6, wherein the securing member comprises a seal plate.

8. A gas turbine rotor according to claim 6, wherein at least some of the fluid pathway is defined between the securing member and the blade mounting member.

9. A gas turbine rotor according to claim 6, wherein a fluid directing formation is provided on the securing member and extends from the securing member towards the blade engaging member.

10. A gas turbine rotor according to claim 9, wherein the fluid directing formation extends in a downstream and upstream direction from the securing member.

11. A gas turbine rotor according to claim 9, wherein the fluid directing formation is provided on the securing member, the fluid directing formation extends at least partially across the outer surface of the blade mounting member.

12. A gas turbine rotor according to claim 9, wherein the fluid directing formation on the securing member is angled relative to the axis of the engine.

13. A gas turbine rotor according to claim 1, wherein the blade mounting member comprises an outer surface extending between adjacent blades, and the fluid directing formation is arranged to direct the cooling fluid across said outer surface.

14. A gas turbine rotor according to claim 13, wherein the fluid is directed externally across the outer surface in the form of a film of said fluid.

15. A gas turbine rotor according to claim 1, wherein the fluid pathway comprises at least one channel extending through the blade mounting member across, and adjacent to, the outer surface.

16. A gas turbine rotor according to claim 15, wherein the at least one channel comprises an internal elongate conduit extending through the blade mounting member adjacent the outer surface.

17. A gas turbine rotor according to claim 15, wherein the at least one channel comprises at least one elongate recess.

18. A gas turbine rotor according to claim 17, wherein the, or each, elongate recess has an elongate opening in the outer surface of the blade mounting member.

19. A gas turbine rotor according to claim 18, wherein the blade mounting member defines a plurality of said recesses extending across the outer surface.

20. A gas turbine rotor according to claim 18, wherein the blade mounting member has a radially outer surface and the at least one recess opens onto the radially outer surface.

21. A gas turbine rotor according to claim 17, wherein the at least one elongate recess opens in the side of the blade mounting member, and an internal conduit is defined with the blade that engages the aforesaid side of the blade mounting member.

22. A turbine incorporating a rotor as claimed in claim 1.

23. A gas turbine engine incorporating a turbine rotor as claimed in claim 22.

* * * * *